US005325694A

United States Patent [19]

Jenista

[11] Patent Number: 5,325,694

[45] Date of Patent: Jul. 5, 1994

[54] EXTRUSION BILLET TAPER QUENCHING SYSTEM

[75] Inventor: David R. Jenista, Wyoming, Mich.

[73] Assignee: Granco Clark, Inc., Grand Rapids, Mich.

[21] Appl. No.: 31,628

[22] Filed: Mar. 15, 1993

[51] Int. Cl.[5] ..... B21C 31/00

[52] U.S. Cl. ..... 72/20; 72/271; 72/270

[58] Field of Search ..... 72/20, 253.1, 270, 271

[56] References Cited

U.S. PATENT DOCUMENTS 2,639,810 5/1953 Doan .
5,027,634 7/1991 Visser et al. .

FOREIGN PATENT DOCUMENTS 135416 6/1986 Japan ..... 72/271
89128 3/1992 Japan ..... 72/271

OTHER PUBLICATIONS

Biswas et al, "Computer Simulation of Extrusion Press Operation Experience with CADEX, A New Computer Aided Process Optimizing System".
Kelly et al, "Simulated Isothermal Extrusion".
Venas et al, "Isothermal Extrusion Principles and Effect on Extrusion Speed".
Johnen, "Induction Billett Heaters with Hot Log Shears and Integrated Shock Heating System and Self-Contained Induction Shock Heaters".

*Primary Examiner*—Lowell A. Larson
*Attorney, Agent, or Firm*—Warner, Norcross & Judd

[57] ABSTRACT

The specification discloses a dynamic self-adjusting taper quenching system for producing isothermal extrusions in a nonferrous extrusion operation. The quenching system includes a quenching unit, a computer for controlling the quenching unit, and an interface for reading the extrusion press ram pressure. A target quenching profile is stored in the computer. The computer samples the ram pressure during extrusion of a quenched billet and adjusts the target quenching profile for subsequent billets as a function of the sampled pressures.

18 Claims, 8 Drawing Sheets

EXTRUSION BILLET TAPER QUENCHING SYSTEM

BACKGROUND OF THE INVENTION

The present invention relates to extrusion billet quenching systems, and more particularly to such systems for creating a tapered quench in a heated billet.

A conventional nonferrous extrusion system typically includes a billet furnace, an extrusion press, and additional "downstream" equipment to handle the extruded material. Billets or logs are heated in the furnace to a temperature suitable for extrusion. The heated billets are then extruded by the press. Heating homogenizes metallic compounds within the billet and renders the billet suitably plastic for extrusion.

Extrusion press rams operate at a uniform speed for the entire length of a billet to reduce the amount of heat build-up in the billet. The billet exits the furnace typically having a uniform temperature throughout its entire length. As is well known the billet temperature changes during uniform-speed extrusion. Specifically, the rear end of the billet adjacent the press ram heats up as it is forced through the container. This heat is created by the friction between the billet and the container during extrusion. The nonuniform billet temperatures create several problems. First, "hot" extrusions can include tears or surface blemishes. Second, the extrusion die flexes with varying temperatures and pressures creating variations in the extrusion profile. Such flexing makes it impossible to maintain tight tolerances. Therefore, the desirability of providing a temperature gradient throughout at least a portion of the extrusion billet prior to extrusion has long been recognized. If the rear end of the billet has a temperature below that of the forward end when the billet is placed in the press, the temperature of the billet throughout its length will be more uniform during extrusion. Accordingly, the concept of isothermal extrusion, meaning that the temperature of all billet material passing through the die is uniform, has long been recognized as desirable.

One technique of providing the temperature gradient involves the use of induction furnaces having a series of induction heaters along the length of the billet. The induction heaters can be controlled to heat each section of the billet to a different temperature. The rear end of the billet can be heated to a temperature below that of the forward end of the billet. This technique is suitable only with induction heating, which is relatively slow. This technique of providing a temperature gradient is not suited to non-induction-type furnaces.

Granco Clark, Inc., the owner of the present application, has developed three previous techniques for quenching the rear end of the heated billet after it exits the furnace and before it enters the press. The first technique is the use of a water ring that surrounds and is moved manually along the billet. The efficacy of this technique depends on the judgment of a human operator. Unfortunately, this technique often results in the entire billet being cooled a uniform temperature throughout its length. The second technique is spraying water in a longitudinal direction against the rear end of the billet. This technique requires excessive time to quench the rear end. Consequently, the entire billet often cools down; and this technique also is subject to human judgment. The third technique is illustrated in U.S. Pat. No. 5,027,634 to Visser et. al. entitled SOLUTIONIZING TAPER QUENCH. The taper quench includes a water-spray ring and a transport mechanism for moving a billet back and forth through the ring. The transport mechanism operates at a single operator-selected speed for a single operator-selected length. Although an improvement over prior techniques, this technique also is subject to human judgment.

SUMMARY OF THE INVENTION

The aforementioned problems are overcome in the present invention wherein a controllable taper quenching system dynamically updates its performance to provide true isothermal extrusion. The taper quenching system includes a taper quenching device for introducing a cooling liquid onto the billet. The system further includes a computer for storing a target tapering profile. The computer is interfaced with the pressure sensor for hydraulic fluid supplied to the press ram. The computer samples this pressure during extrusion of a billet. Based on these samplings, the computer modifies the target tapering profile according to an algorithm intended to produce a more uniform die pressure throughout the length of the billet.

An important advantage of the present system is the improvement in uniformity of die pressure throughout the entire billet length. This results in extruded articles of highly improved quality and highly uniform tolerances. Flexing of the die is kept to a minimum. A second advantage is reduced tearing and surface blemishing. A third advantage is that the billet "crushes" or "upsets" progressively in the press container throughout its length from front to back as is highly desired to reduce trapped air in the container.

These and other objects, advantages and features of the invention will be more readily understood and appreciated by reference to the detailed description of the preferred embodiment and the drawings.

DETAILED DESCRIPTION OF THE PREFERRED EMBODIMENT

Figure 1:
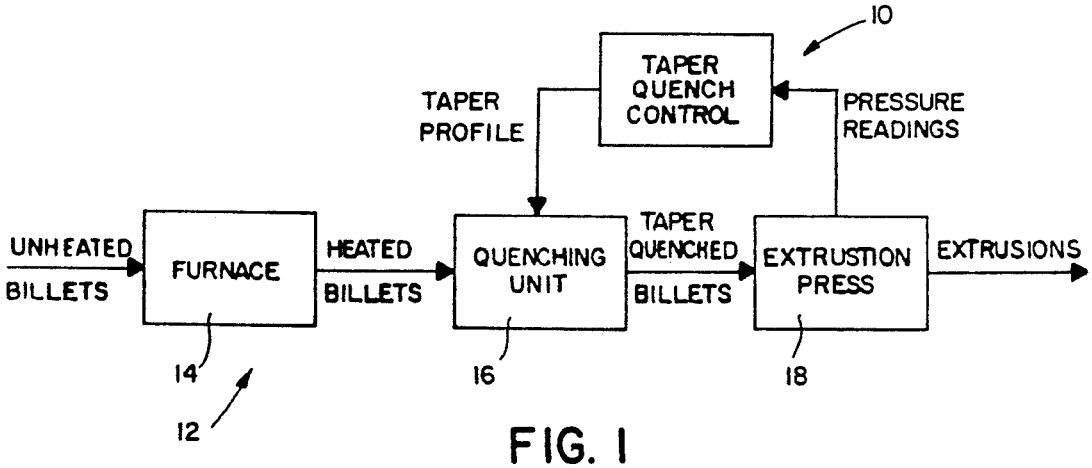
FIG. 1 is a schematic diagram of the extrusion system components related to the taper quench system of the present invention.

The components of an extrusion line 12 incorporating the present invention are illustrated in FIG. 1. The components include a taper quench control 10, a furnace 14, a quenching unit 16, and an extrusion press 18.

As schematically illustrated in FIG. 1, unheated extrusion billets or logs are sequentially inserted into the furnace 14 for heating. The billets can be any of a wide variety of well known materials. Typically, the billets are composed of aluminum alloys, although other nonferrous alloys may be used. The furnace 14 may be any one of a variety of well known billet furnaces. By way of example only, the furnace could be that sold by Granco Clark, Inc. of Grand Rapids, MI as model 69-35-3.

The heated billets exit the furnace sequentially and are processed in the quenching unit 16. The quenching unit may be any of a variety of units for producing a quenching profile in a heated billet. Suitable units include that illustrated in U.S. Pat. No. 5,027,634 and the quenching unit 16 described herein.

The taper-quenched billets exit the quenching unit 16 and sequentially enter the extrusion press 18. The extrusion press operates to extrude the heated and taper-quenched billet to produce extrusions. The extrusion press 18 may be any of a wide variety of suitable nonferrous extrusion presses. By way of example only, the extrusion press 18 may be the 2250-ton press sold by SMS Engineering (Sutton Division) of Pittsburgh, Pa.

I. Taper Quench Control System

The taper quench control 10 schematically illustrated in FIG. 1 interfaces with both the quenching unit 16 and the extrusion press 18. As will be described in greater detail, the control 10 stores a target tapering profile for billets being processed through the system. The control 10 controls the function of the quenching unit 16 according to the stored taper profile to produce the desired taper in the heated billet. During extrusion of the taper quenched billet, the control 10 obtains pressure readings from the extrusion press ram 18. The control computer 10 converts each ram press reading into a derived die-face pressure reading. Ideally, the derived pressure readings are uniform throughout the length of the billet. If the derived pressure readings vary from uniform by defined amounts, the control 10 modifies the target tapering profile in a manner anticipated to produce more uniform die pressures throughout the length of the billet. Alternatively, and with equal applicability, the computer 10 could control an induction furnace rather than quenching unit 16 as illustrated.

Figure 2:
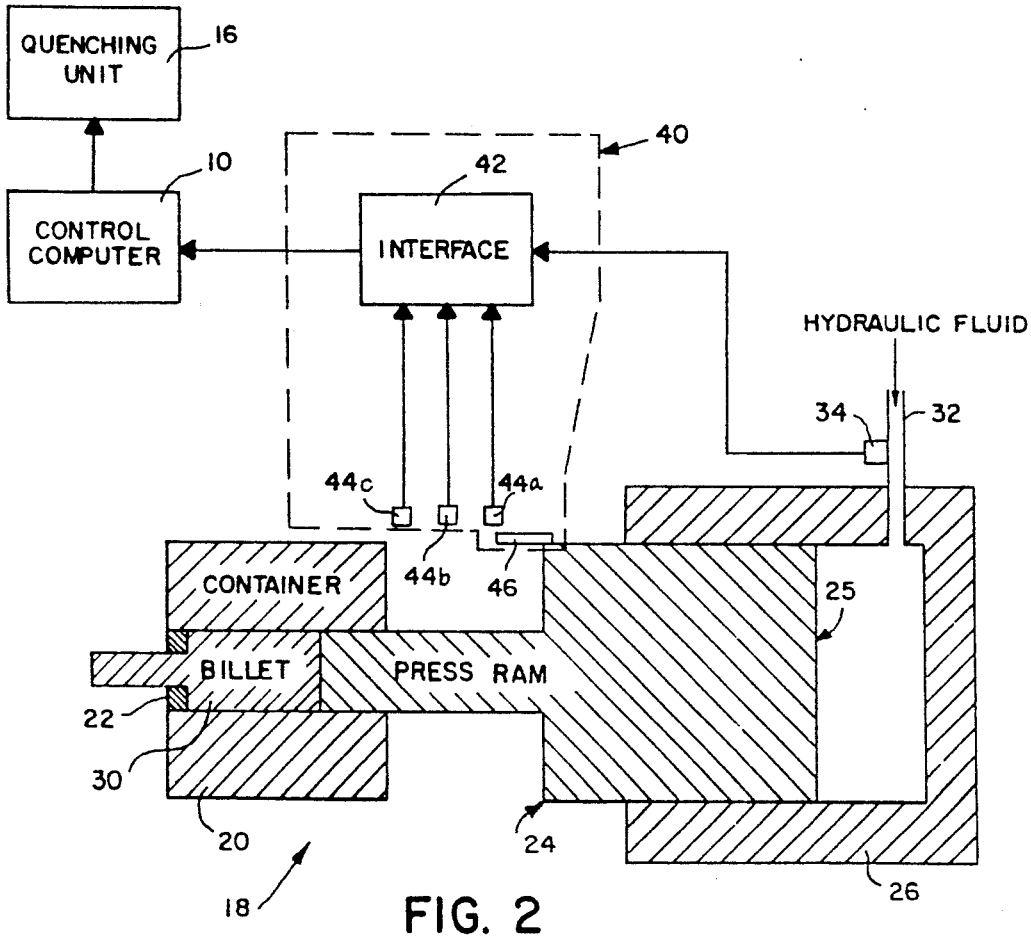
FIG. 2 is a schematic diagram of the taper quench control computer interfaced with the extrusion press and the quenching unit.

The control computer interfaces with both the quenching unit 16 and the extrusion press 18 as illustrated in greater detail in FIG. 2. The extrusion press includes a container 20 supporting an extrusion die 22 through which the billet is extruded, a press ram 24, and a hydraulic cylinder 26. The container is dimensioned to receive a billet 30 when the press ram 24 is withdrawn from the container 20. The press ram is then actuated to enter the container and to extrude the billet through the die 22 as illustrated in FIG. 2. A line 32 provides a source of pressurized hydraulic fluid to the ram cylinder 26 to operate the press ram. A pressure sensor 34 mounted on the line 32 provides a means of reading the hydraulic pressure within the cylinder 26. All components of the press 18 as thus far described are conventional in the art.

The pressure reading system 40 of the present invention provides an interface between the extrusion press 18 and the control computer 10. The system 40 includes an interface 42, three switches 44*a*, 44*b*, and 44*c*, and a trigger arm 46. The trigger arm 46 is mounted on the press ram 24 to actuate the switches 44 during operation of the press ram. The switches 44 are generally well known to those having ordinary skill in the art and in the preferred embodiment are photo-electric switches. The dimensions and pressures described in conjunction with the present embodiment are those specifically designed for a system capable of processing billets 7 inches in diameter and up to 32 inches in length. The surface area of the piston head 25 of the main ram 24 is 1500 square inches. The system assumes that all billets will be greater than 18 inches in length. Of course, the system could be designed for other billet diameters and lengths; or even most preferably is capable of supporting a variety of billet diameters and lengths.

The switches 44 are presently positioned so that the arm 46 triggers the switches when the ram head is at the following distances from the face of the extrusion die 22:

| Switch | Distance |
|---|---|
| 44a | 30 inches (Billet length minus 2 inches) |
| 44b | 16 inches |
| 44c | 4 inches |

Consequently, the switches 44 are triggered sequentially (a) 2 inches after billet/die breakthrough, (b) with 16 inches of the billet remaining, and (c) with 4 inches of the billet remaining. Other switch positions could be utilized. Alternatively, and preferably, the switch signals can be generated by the extrusion press control system, eliminating the need for physical switches. As each switch is triggered, the control computer 10 Samples or reads the pressure sensor 34 through interface 42. These three pressure readings are then used to modify the tapering profile as necessary.

All switches 44 are connected through the interface 42 to the control computer 10. The pressure sensor 34 is also connected through the interface 42 to the computer 10.

Ideally, the control computer 10 would like to have a precise reading of the pressure against the die face 22. For purposes of the present invention, this pressure is approximated/derived by sampling the pressure of the fluid within the main ram cylinder. The die face pressure is equal to (a) the hydraulic pressure within the main ram cylinder 26 minus (b) the friction factor of the container wall times the remaining length of the billet minus (c) the deformation factor of the billet. The friction factor for any particular billet/container combination is well known. In the described press having the described dimensions, the friction factor is 38 psi per inch. The deformation factor is significant only as the last portion of the billet is being extruded. For the described container and billet combination, the deformation pressure is approximately 50 psi with 4 inches of the billet remaining in the container.

In the present embodiment, the target profile defines both a length and a temperature gradient over that length. For example, a target profile of "120/16" defines a profile wherein a uniform temperature gradient of 120 degrees Fahrenheit is produced over the 16 inches of the billet adjacent the rear face of the billet. Of course, other definitions are possible.

Figure 3:
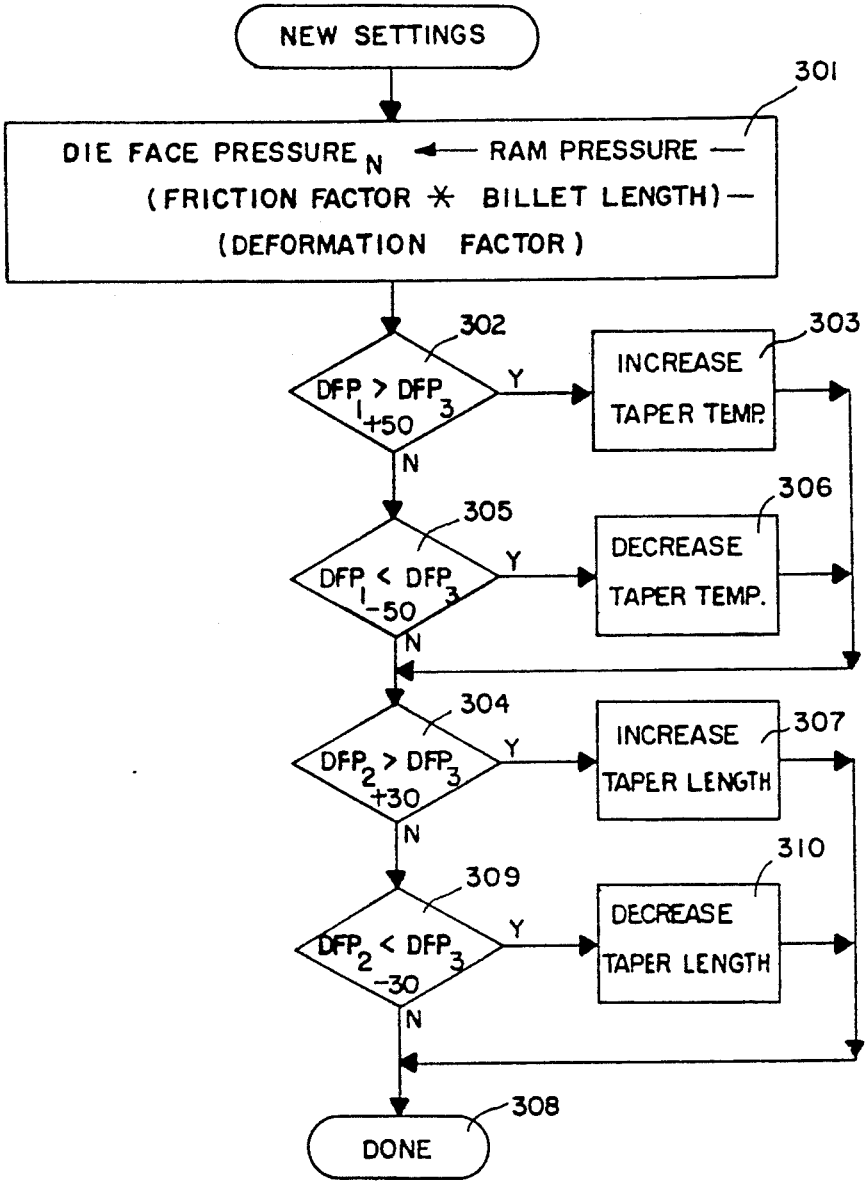
FIG. 3 is a flow diagram illustrating a portion of the program operation of the control computer.

FIG. 3 illustrates the operation of the software in modifying the tapering profile. The three sampled ram pressures taken as the three switches were triggered must be converted to die face pressures (DFPs). The formula for so converting the ram pressures is illustrated in block 301. The three derived die face pressures corresponding to switches 44*a, b,* and *c* are referred to as DFP 1, DFP 2, and DFP 3.

The remaining portion of the flow diagram following block 301 adjusts the target profile as necessary in an attempt to drive the three pressure readings to equivalency within a defined degree of error. In block 302, DFP 1 is compared with DFP 3. If DFP 1 is greater than DFP 3, the taper temperature is increased 303; and program flow continues to block 304. If DFP 1 is not greater than DFP 3, program flow continues to block 305 to determine whether DFP 1 is less than DFP 3. If so, the taper temperature is decreased 306. In either event, program flow continues at block 304. For both comparisons 302 and 305, a difference of up to 50 psi is acceptable and will not trigger a temperature change.

In block 304, DFP 2 is compared with DFP 3. If greater, the taper length is increased 307 and the profile modification is complete 308. If DFP 2 is not greater than DFP 3, program flow continues at block 309, where DFP 2 is compared with DFP 3. If DFP 2 is less than DFP 3, the taper length is decreased 310; and the profile modification is complete 308. For both comparisons 304 and 309, a difference of 30 psi is acceptable and will not trigger a length change.

As will be understood from the foregoing, (1) if DFP 1 and DFP 2 are both within 30 psi of DFP 3, no action is taken; (2) if DFP 2 differs from DFP 3 by more than 30 psi, the taper length is modified; and (3) if DFP 1 differs from DFP 3 by more than 50 PSI, the taper temperature is modified.

If the taper temperature is modified (either increased 303 or decreased 306), it is done as follows. If the difference between DFP 1 and DFP 3 is 50 to 150 psi, the temperature is changed 5 degrees. If the difference between DFP 1 and DFP 3 is greater than 150 PSI, the temperature is changed 20 degrees.

If the taper length is modified (either increased 307 or decreased 310), it is done as follows. If the difference between DFP 2 and DFP 3 is greater than 30 psi, the taper length is modified by 1 inch. Most preferably, the taper length is not modified until DFP 1 and DFP 3 are within 150 psi of each other.

If any type of change is made to the target tapering profile, another change is not made for at least two billets. This permits two billets heated according to the "old" profile (i.e. the billet just inserted into the press and any billet on a transveyor table between the quenching system and the press) to clear the press before "new" pressure readings are taken. This technique could be modified if the system physically monitors for billets on the transveyor table.

The default target profile is "120/16" (120 degrees over 16 inches). This target will of course vary depending on the die, the billet, and the press. These values are believed to be appropriate for the described billet size.

If the control system is used in conjunction with a supervisory control system as described in U.S. Pat. No. 5,126,945 issued Jun. 30, 1992 entitled NONFERROUS EXTRUSION PROCESS CONTROL SYSTEM, the current target profile at the end of processing can be stored in the appropriate die file as the starting point for subsequent processing. Such a procedure provides a more accurate starting point for subsequent extrusion using the same die.

Figure 4:
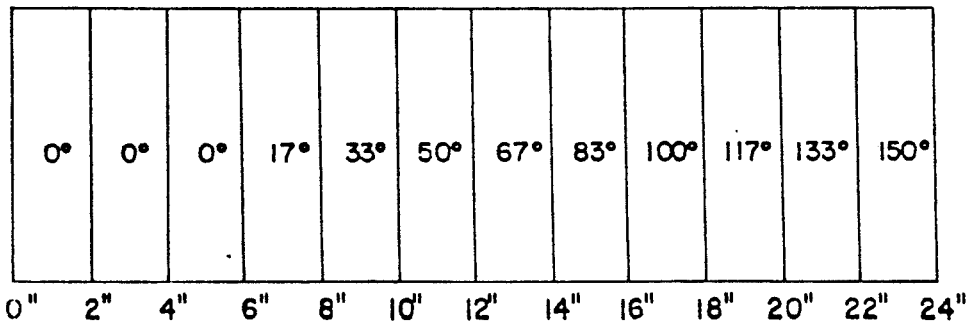
FIG. 4 is a schematic diagram of a billet taper-quenched according to the present invention.

FIG. 4 illustrates a billet having the temperature gradient in a 24 inch billet when quenched with a "150/18" profile. The temperature gradient is modified every two inches along the length of the billet. As can be seen in FIG. 4, no quenching is provided in the first six inches of the 24 inch billet. The gradient is introduced in only the defined rear 18 inches. The remaining quench is evenly incremented every two inches between 17 degrees in the 6-to-8-inch segment to 150 degrees in the 22- to-24-inch segment. This technique provides a balance between the present physical practicalities of quenching and a continually uniform gradient over the taper length.

Figure 5:
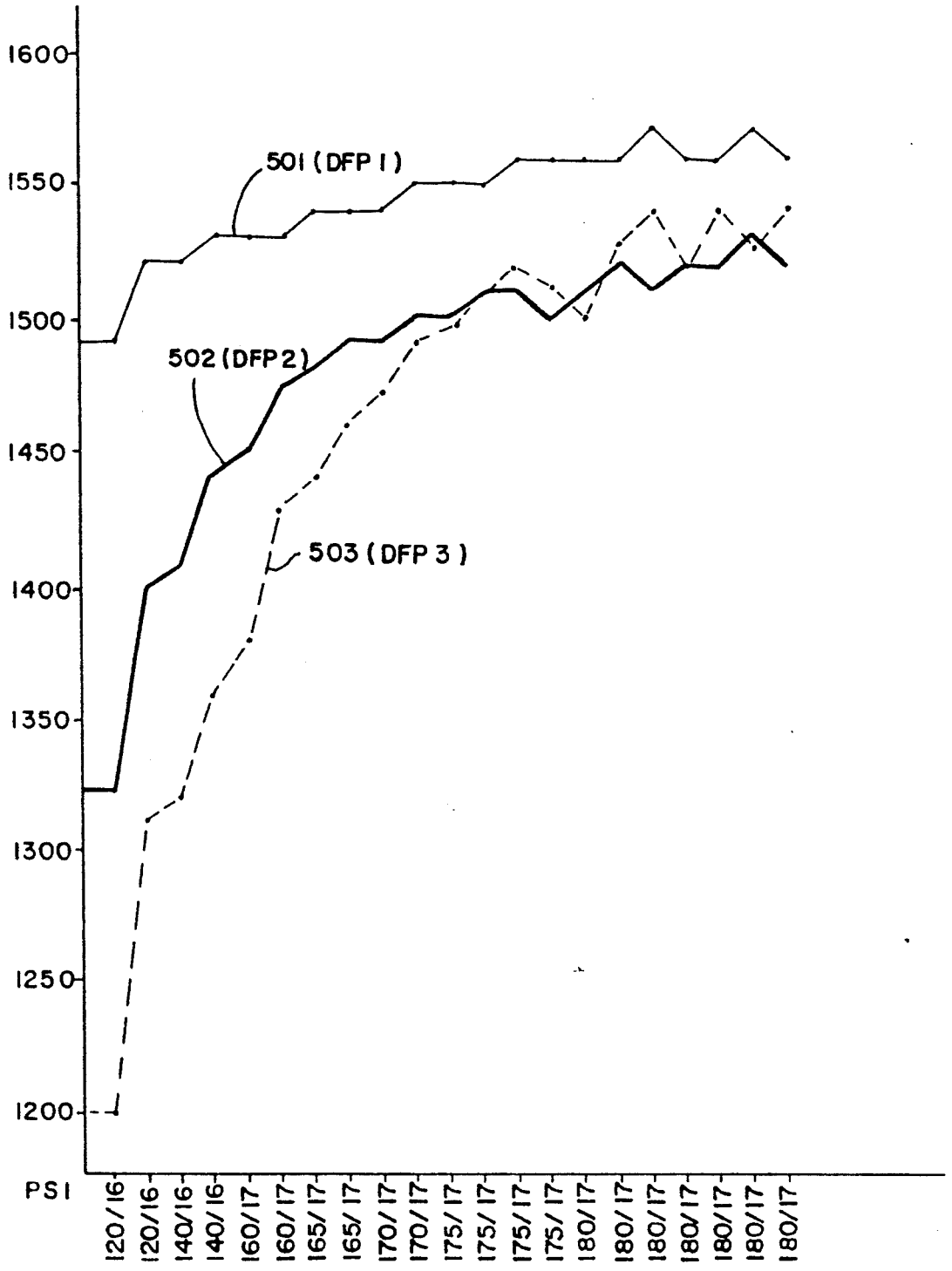
FIG. 5 is a diagram illustrating the results of the taper quench control system on sequentially processed billets.

FIG. 5 illustrates the actual effect of the present taper quench control system in producing relatively uniform die face pressures. The horizontal axis identifies the sequential billets extruded through a single die. Each billet is identified by its tapering profile. The vertical axis identifies the derived die face pressures as the billets are extruded. The top line 501 represents the readings at switch 44*a* (i.e. after breakthrough); line 502 represents the readings at switch 44*b* (i.e. with 16 inches of billet remaining in the container); and line 503 represents the readings at switch 44*c* (i.e. with four inches of billet remaining in the container). It is readily apparent that the system modifies itself from the initial default reading of "120/16" to the equilibrium profile of "180/17." As the target profile is modified, it is readily seen that the die face pressures standardize at values between 1500 and 1550 psi. These values are equivalent (within the defined parameters) to one another. Modification of the furnace exit temperature may be performed to adjust the equilibrium pressure as desired.

The present invention therefore produces die face pressures of vastly improved uniformity along the entire length of the billet. This reduces tearing and surface blemishing of the extrusions. This also results in an improved ability to hold close tolerances since die flexing is greatly reduced. At the same time, the system is fully compatible with uniform press speeds to obtain truly isothermal extrusions.

II. Taper Quench Unit

The taper quench unit 16 is illustrated in detail in FIGS. 6–9. Generally speaking, the unit 16 includes a billet guide 104, a water ring assembly 106, and a billet transportation or drive unit 108 having a carriage 110. A conventional transveyor table extends through the quenching unit 16. With the exception of the water ring assembly 106 and the pusher arm 110, the quenching unit 16 is generally similar to that disclosed in U.S. Pat. No. 5,027,634. Accordingly, the common components will be described briefly; and reference is made to the cited patent for a more complete discussion of the common items.

Figures 6, 9:
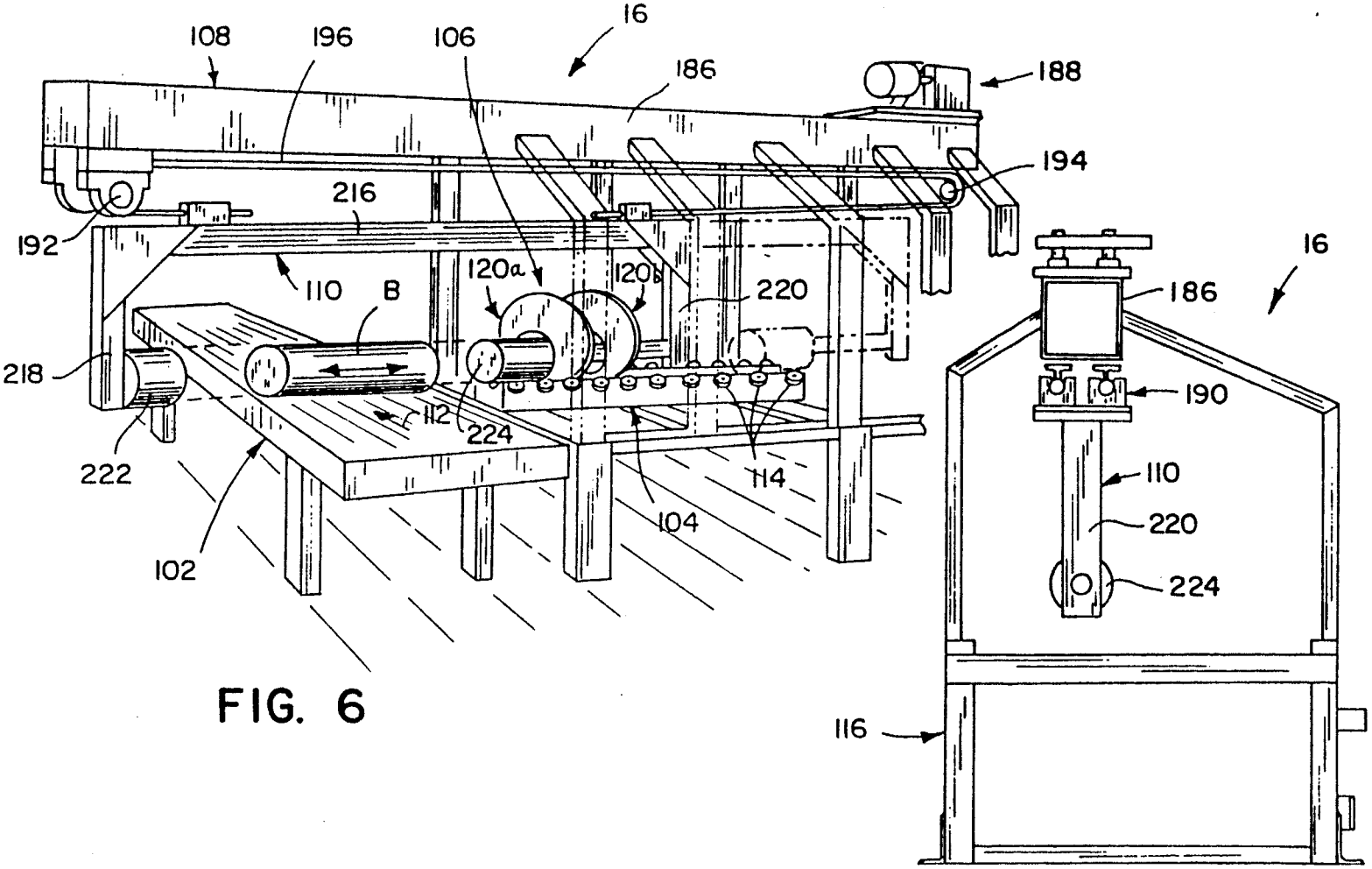
FIG. 6 is a perspective view of the taper quenching unit of the present invention.
FIG. 9 is an end elevational view of the taper quenching unit taken from the right of FIG. 7.

Transveyor table 102 (FIGS. 6–7) is generally well known to those having skill in the art and is schematically illustrated in FIG. 6. The transveyor table conveys heated billets from the furnace 14 to the extrusion press 18. The transveyor table 102 conveys the billets in the direction indicated by arrow 112 (i.e. in a direction generally transverse to the longitudinal direction of the billet). The transveyor table 102 operates under computer control and may be stopped with the billet in the location illustrated in FIG. 6 generally aligned with the water ring assembly 106.

The billet guide assembly 104 (FIGS. 6 and 7) is also known and is disclosed in U.S. Pat. No. 5,027,634. The guide assembly 104 includes a plurality of rollers 114. The rollers are unpowered and rotatably support a billet moving in a longitudinal direction through the water ring assembly 106 (i.e. perpendicular to billet movement on the transveyor table 102). The billets move along the guide assembly 104 under the driving force of the billet drive unit 108 to be described below. The billet guide 104 is supported on a frame 116.

Figure 7:
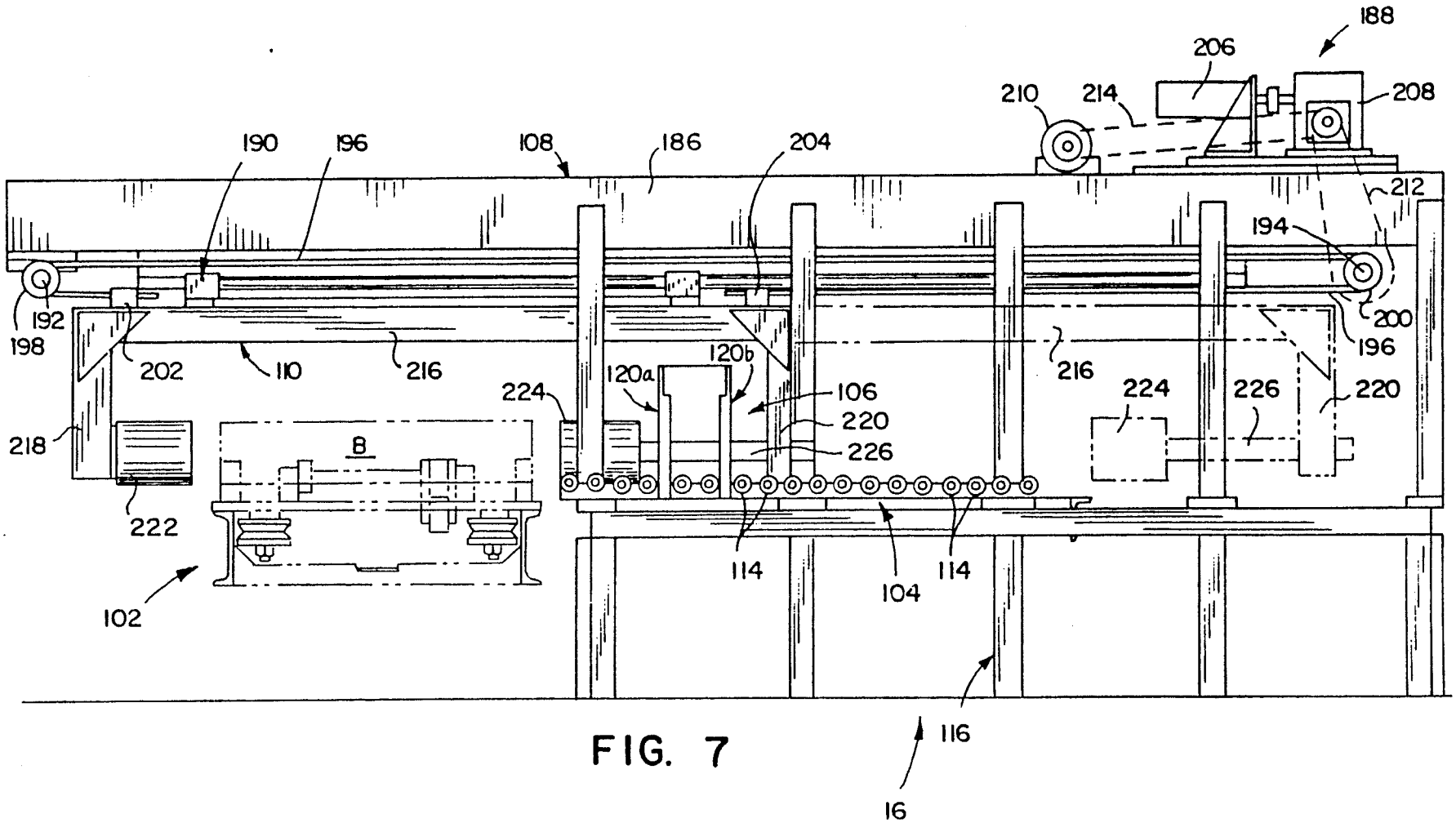
FIG. 7 is a side elevational view of the taper quenching unit.

The water ring assembly 106 is schematically illustrated in FIGS. 6 and 7 and includes a pair of water rings 120*a* and 120*b*. Generally speaking, each ring includes a central opening aligned with the other so that billets supported on and rolling along the guide assembly 104 will pass through the water rings 120. The water rings discharge water onto the cylindrical wall of the billet to provide a cooling function. As will be described, the cooling can be controlled to provide either solutionizing or taper quenching.

Water rings 120*a* and 120*b* are generally identical to one another and are arranged so as to "face" each other as will be described. Accordingly, only one water ring assembly will be described in detail.

Figure 10:
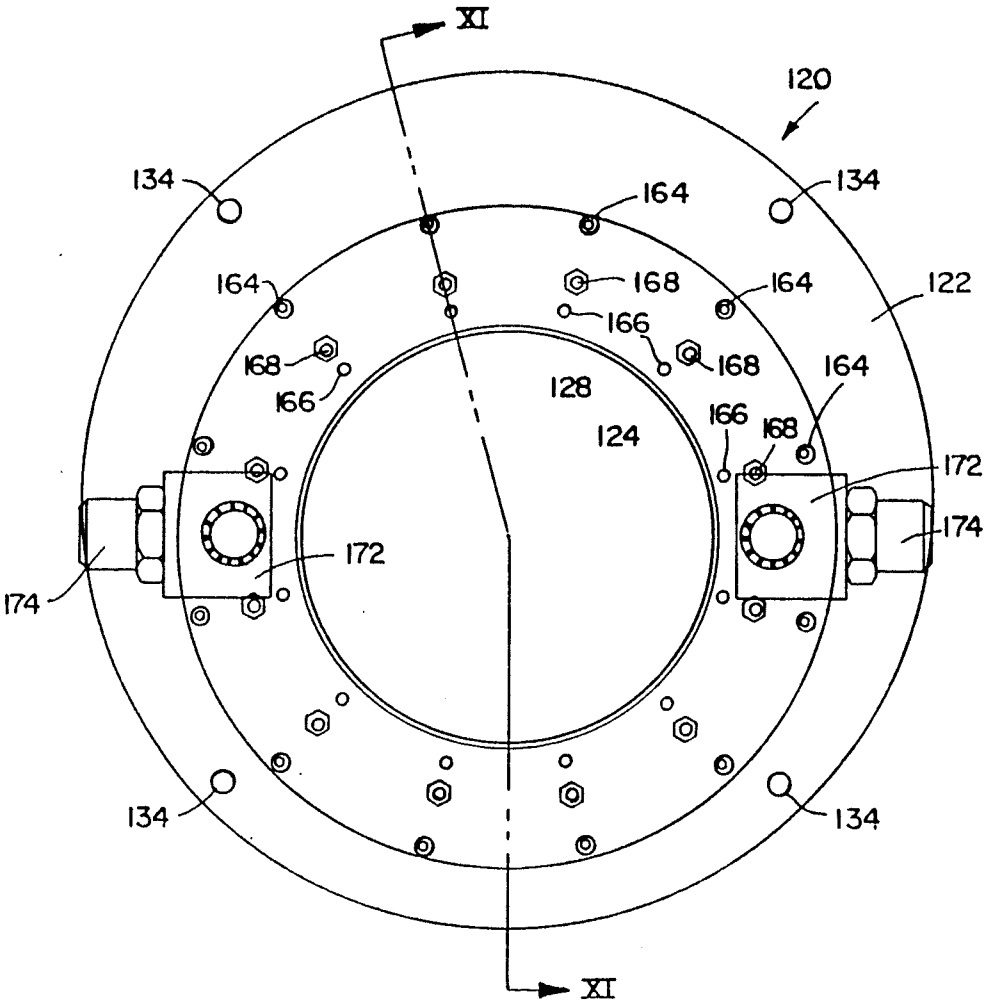
FIG. 10 is an elevational view of the water ring assembly.
Figure 11:
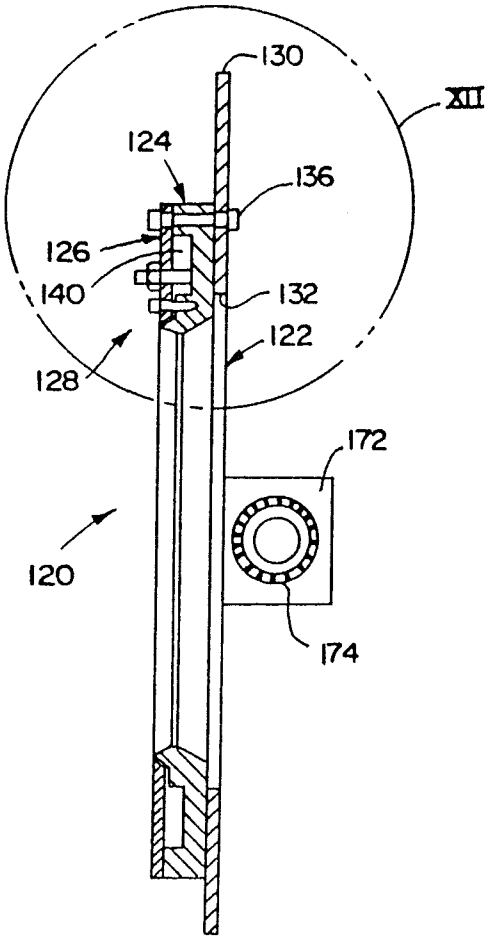
FIG. 11 is a sectional view taken along line XI—XI in FIG. 10.

Turning to FIGS. 10 and 11, the water ring assembly 120 generally comprises three sandwiched rings—a mounting ring 122, a spray ring 124, and a ring cap 126. The three plates are bolted together and define a continuous water discharge opening 128 extending about the entire periphery of the water ring 120. All three plates are preferably fabricated of #309 stainless steel. Of course, other materials may be used.

The mounting ring 122 is a planar ring having a circular exterior edge 130 and a circular interior opening 132 eccentric with respect to the exterior edge. The mounting ring 130 defines a plurality of radially evenly spaced holes about its circumference through which cap screws 134 extend to mount and support each water ring 120 in the remaining structure of the assembly 106 as will be described. Each mounting plate 130 also defines a plurality of holes evenly spaced radially through which cap screws 136 extend to anchor the mounting plate to the spray ring 124.

Figure 12:
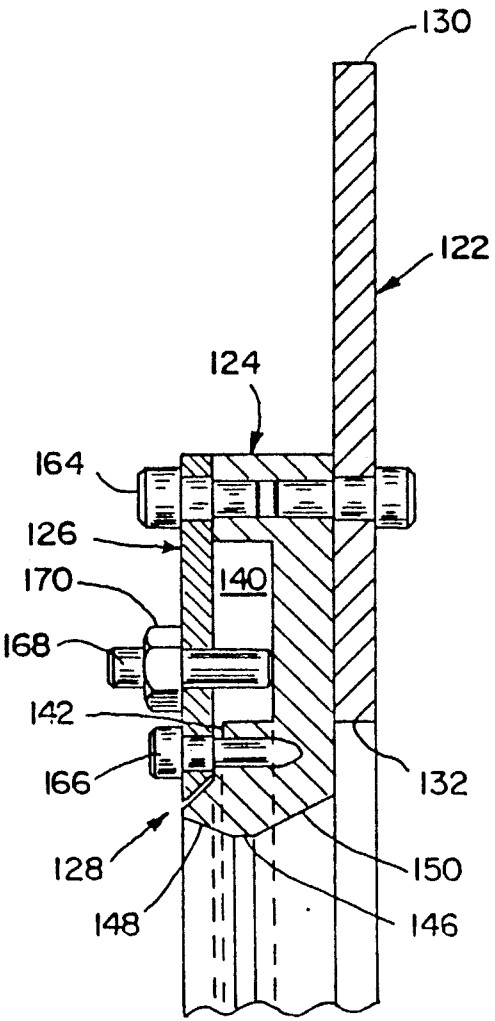
FIG. 12 is an enlarged view of the area within line XII in FIG. 11.
Figure 13:
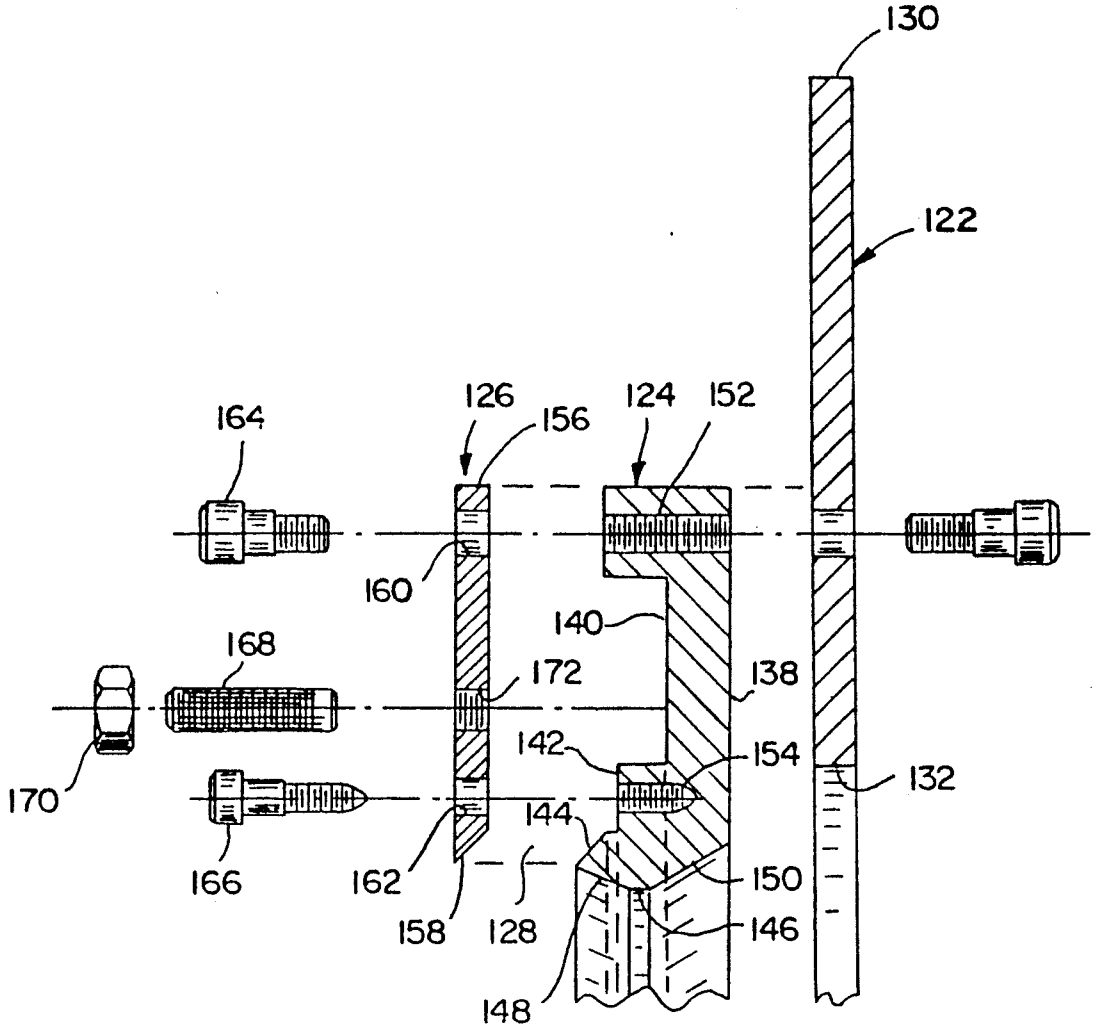
FIG. 13 is an exploded view of FIG. 12.

The spray ring 124 is not flat as are rings 122 and 126. The cross sectional configuration of the spray ring 124 is most clearly seen in FIGS. 12 and 13. The spray ring 124 includes a flat side 138 which abuts and lies against the flat mounting ring 122. The opposite side of the spray ring 124 includes an annular recess or water chamber 140 for conveying flow through the water ring 120 to the discharge opening 128. Immediately adjacent radially inward from the water chamber 140 is a recess 142, whose depth is considerably less than that of the chamber 140. The recess 142 provides a flow path from the water chamber 140 to the discharge opening 128. Extending from the recess 142 is a bevelled surface 144 which defines one side of the discharge opening 128. In the preferred embodiment, the angle of surface 144 is 45 degrees from the plane defined by the spray ring 124. The interior wall of the spray ring 124 includes a central portion 146 and angled surfaces 148 and 150 extending radially outwardly therefrom. The surfaces 148 and 150 help guide a slightly misaligned or out of size billet through the ring. The spray ring 124 defines a plurality of threaded apertures 152 evenly spaced radially about the circumference of the spray ring radially outward of the water chamber 140. Similarly, the spray ring 124 defines a plurality of threaded apertures 154 evenly spaced radially about the circumference of the spray ring intermediate the water chamber 140 and the interior wall 146.

The ring cap 126 is also a flat ring including an exterior edge 156 and an interior opening 158. The interior wall is angled at 45 degrees from the plane defined by the ring 126, which preferably is identical to the angle of the surface 144 on the spray ring. The surfaces 158 on the ring cap and 144 on the spray ring together define the continuous discharge opening 128 extending about the entire periphery of the spray ring assembly 106. The ring cap 126 includes a plurality of throughbores 160 and 162 evenly spaced radially about the circumference of the spray ring. The throughbores 160 are aligned with the threaded bores 152; and the throughbores 162 are aligned with the threaded bores 154. Cap screws 164 retain the ring cap 126 to the spray ring 124. No gasket is required between the mating surfaces.

The adjustment mechanism for adjusting the width of the discharge opening 128 includes a plurality of cap screws 166, plurality of set screws 168, and a plurality of hex nuts 170. The cap screws 166 extend through the ring cap 126 and are threaded within the spray ring 124. The cap screws 166 provide a means for positively narrowing the discharge opening 128. The spray ring 126 includes a plurality of threaded bores 172 evenly spaced about its circumference. Set screws 168 are positioned within the bores 172 and bear against the floor of the water chamber 140 (see FIG. 12). Consequently, the set screws 168 provide a means of positively widening the discharge opening 128. Hex nuts 170 are provided for the conventional function of locking the set screws 168 in their adjusted position. Because the set screws 166 and 168 are provided about the perimeter of the ring cap 126, the width of the discharge opening 128 can be carefully adjusted about its entire perimeter. In the presently preferred embodiment, the discharge opening is 0.007 inch. With a water ring having an internal diameter of 7.375 inches and a water delivery pressure of 125 psi, such opening results in a discharge volume of approximately 55 gpm. Of course, the width of the discharge opening 128 and the water delivery pressure can be adjusted to deliver the desired flow.

Each water discharge ring 120 provides a circumferentially continuous curtain of water. Water flow therefore is more uniform than in previous constructions and enables the solutionizing or taper quenching operation to be more precisely controlled. The slot width can be easily adjusted—either narrowed or widened—at a plurality of locations about the perimeter of the ring. Servicing is simplified because the ring cap 126 is easily removed from the spray ring 124, providing full access to all water flow paths defined by the two components.

Returning to FIGS. 10 and 11, an inlet flange 172 is secured to the mounting ring 122, and a conventional connector 174 is mounted within the flange 172 to provide water connections to the spray ring 124. Although the water passages are not specifically shown, such will be readily apparent to one having skill in the art. The present water delivery system provides water under the control of computer 10 at selectable rates of 50, 75, and 125 gpm. Other rates could be provided as desired.

Figure 8:
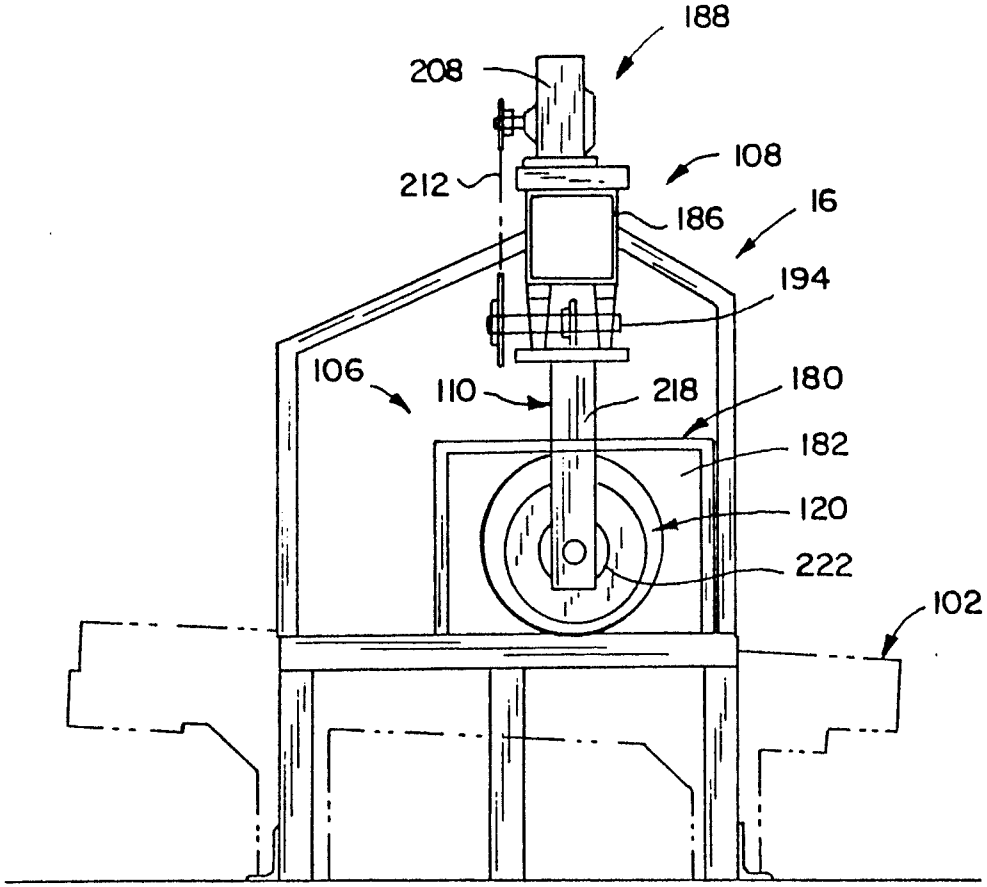
FIG. 8 is an end elevational view of the taper quenching unit taken from the left of FIG. 7.

As perhaps best illustrated in FIG. 8, the two water rings 120 are mounted in opposite sides of a cover or shroud box 180. The shroud box includes a pair of opposite side plate weldments 182 (only one shown in FIG. 8) on which the water ring 120 is mounted using bolts 134 (see FIG. 10). The cover 180 is of conventional construction to shroud and/or contain the water discharged from the rings 120.

The rings 120 are mounted so as to "face" one another. This means that the discharge openings 128 are both directed towards the central portion of the assembly 106. Directing the two water curtains toward one another helps contain and control the cooling water to more carefully regulate the temperature change of the billet. For seven-inch-diameter billets, it has been found that a ten-inch spacing between the rings 120 is optimal. This water containment theory is generally similar to that described in U.S. Pat. No. 5,027,634.

The billet transportation unit 108 (FIGS. 6–9) includes a beam 186, a carriage 110, and a drive unit 188. The beam 186 is supported in conventional fashion on a frame to be located above the billet guide assembly 104. The carriage 110 is suspended from the beam 186 on a slide mechanism 190 of a type generally well known to those having ordinary skill in the art. An idler shaft 192 and a drive shaft 194 (FIG. 7) are mounted on the beam 186. A roller drive chain 196 is entrained about sprockets 198 and 200 carried on idler shaft 192 and drive shaft 194, respectively. The roller chain is connected to the opposite ends of the carriage 110 in the fittings 202 and 204. The roller chain 196 is propelled by the drive unit 188 which includes a servomotor 206, a gear reducer 208, and an encoder 210. A roller chain 212 interconnects the gear reducer 208 and the drive shaft 194 to provide power to the roller chain 196. The roller chain 214 interconnects the gear reducer 208 and the encoder 210.

Both the servomotor 206 and the encoder 210 are coupled to the taper quench control 10 in conventional fashion so that the computer can receive position information from the encoder 210 to control the servomotor 206. Present drive speeds include 0.1 to 8.0 inches per second (ips) during taper quenching and solutionizing, and 8 ips during traversal with no cooling. During taper quenching the speed can be adjusted every two inches of the billet length, although virtually any increment or continuous adjustment could be used in place. The control computer includes a look-up table that includes billet speed and water flow settings for desired quenching temperatures.

The carriage 110 includes a main beam 216 and a pair of depending weldments or arms 218 and 220 at the opposite ends thereof. The left-most or "receiving" position of the carriage is illustrated in FIG. 7, and the right-most or "extended" position is illustrated in phantom in FIG. 7. These two positions are the extreme positions of the carriage. A pusher 222 is cantilevered from the weldment 218, and a pusher 224 is cantilevered from the weldment 220. As can be seen in FIGS. 6 and 7, the pusher heads 220 are cantilevered toward one another and are aligned with the water ring assembly 106 so as to be capable of extending therethrough. Optionally, a water spray (not shown) can be included in the pusher 224 as a further means of cooling the billet B. If included, the spray would be directed axially against the face of the billet B engaged by the pusher 224.

A billet B to be processed is illustrated in FIG. 6 and in phantom in FIG. 7. The maximum billet length is shown. When the carriage 110 is in the receiving position, the billet may move on the transveyor table 102 to a position between the pushers 222 and 224. The carriage 110 is then driven to the right by the driving unit 188 so that the pusher head 222 engages the billet and pushes the billet through the water ring assembly 106. If solutionizing (i.e. uniform temperature reduction) is to be performed, the billet is pushed completely through the water ring assembly 106 at the preselected uniform speed. If taper quenching (i.e. nonuniform temperature reduction) is to be performed, the billet is pushed into the water ring assembly 106 to the point where taper quenching is to begin. As thus described solutionizing is performed in one direction and taper quenching in the other directio. The steps could be reversed, or only one of the two steps performed. The billet is returned to the transveyor table 102 by driving the carriage 110 to the left, whereupon the pusher 224 engages the opposite end of the billet. As is illustrated in FIG. 7, the pusher 222 extends completely through the ring assembly 106 in the extreme extended position; and the pusher 224 extends completely through the ring assembly 106 in the receive position to return the billet to the transveyor table.

The cantilevered pushers 222 and 224 enable both water rings 120 of the water ring assembly 106 to be continuous throughout their circumference. As noted above, this permits a uniform and continuous curtain of water to be directed onto the billet during solutionizing and/or quenching.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A quenching system for a billet extrusion operation, said quenching system comprising:

a controllable quenching unit for quenching a heated billet to be extruded;

memory means for storing a target quenching profile;

interface means for providing an interface with a press ram pressure sensor; and control means coupled to said memory means and said interface means for controlling said quenching unit to quench a heated billet according to the target quenching profile, said control function including sampling said interface means at a plurality of ram positions during extrusion of a quenched billet and modifying the target quenching profile as a function of the sampled pressures.

2. A quenching system as defined in claim 1 wherein the target quenching profile defines a length and a total temperature differential along the length.

3. A nonferrous extrusion system comprising:

a billet furnace;

an extrusion press having a die and a hydraulically actuated ram for forcing a billet through said die;

a pressure sensor for sensing the pressure of hydraulic fluid supplied to said ram; and a taper quenching system for taper quenching a billet between said furnace and said die, said taper quenching system in turn comprising:

a taper quenching unit for quenching a billet;

storage means for storing a target tapering temperature profile; and control means for controlling said taper quenching unit to taper quench a billet according to said target temperature profile, said control means reading said pressure sensor at a plurality of ram positions during extrusion of the quenched billet to produce pressure readings, determining the difference between the pressure readings and the target extrusion pressure, and modifying the target temperature profile as a function of the differences.

4. A nonferrous extrusion system as defined in claim 3 wherein the target temperature profile defines a length and a temperature gradient over the length.

5. A nonferrous extrusion system comprising:

tapering means for selectively creating a temperature profile in a billet;

an extrusion press having a die through which billets are extruded;

memory means for storing a target tapering profile; and control means responsive to said memory means for controlling said tapering means, said control means including sampling means for sampling a parameter related to the pressure exerted by an extruding billet against the die at a plurality of ram positions, said control means including means for modifying the target tapering profile in response to the sampled parameters.

6. An improved nonferrous extrusion system as defined in claim 5 wherein said determining means comprises means for sampling the pressure of hydraulic fluid supplied to said press ram.

7. An improved nonferrous extrusion system as defined in claim 5 wherein the target tapering profile defines a length and a temperature gradient over the length.

8. A method of taper quenching a nonferrous extrusion billet comprising:

storing a target tapering temperature profile;

taper quenching a billet according to the profile;

extruding the billet in a press;

observing during said extruding step at a plurality of press ram positions a parameter related to the pressure of the billet against the extrusion die to produce a plurality of parameter readings; and changing the stored temperature profile as a function of the parameter readings.

9. A taper quenching method as defined in claim 8 wherein said parameter is the pressure of hydraulic fluid supplied to the press ram.

10. A taper quenching method as defined in claim 8 wherein the target temperature profile defines a length and a temperature gradient over the length.

11. A taper quenching method as defined in claim 8 wherein said changing step includes changing the target temperature profile no more often than once every two quenched billets.

12. A taper quenching method as defined in claim 8 wherein the plurality of ram positions includes a first position proximate one end of the billet, a second position proximate the other end of the billet, and a third position in between the first two.

13. A method of extruding a nonferrous billet comprising:

storing a target taper quenching temperature profile;

taper quenching an extrusion billet according to the profile;

extruding the taper quenched billet through an extrusion die;

during said extruding step, sampling a parameter directly indicative of the pressure exerted by the billet against the extrusion die, said sampling occurring at a plurality of extrusion press ram positions; and modifying the target taper quenching profile as a function of the sampled parameters.

14. A taper quenching method as defined in claim 13 wherein said determining step comprises reading the pressure of hydraulic fluid supplied to the press ram.

15. A taper quenching method as defined in claim 14 wherein said modifying step includes compensating for the friction between the billet and the press container wall.

16. A taper quenching method as defined in claim 13 wherein said modifying step comprises modifying the target profile no more often than once every two billets.

17. A taper quenching method as defined in claim 13 wherein the plurality of ram positions includes a first position proximate one end of the billet, a second position proximate the other end of the billet, and a third position between the first two.

18. A method of extruding a nonferrous billet comprising:

storing a target tapering profile defining a length and a temperature gradient over the length;

sampling a parameter indicative of the pressure exerted by the billet against the extrusion die at a plurality of extrusion press ram positions; and modifying the target tapering profile as a function of the sampled parameters.

* * * * *